US010234132B2

(12) United States Patent
Horne et al.

(10) Patent No.: US 10,234,132 B2
(45) Date of Patent: Mar. 19, 2019

(54) LIGHTED TUMBLER HOLDER

(71) Applicant: Alliance Sports Group, L.P., Grand Prairie, TX (US)

(72) Inventors: Gregory Lee Horne, Euless, TX (US); Jimmy Prieto, Grand Prairie, TX (US)

(73) Assignee: Alliance Sports Group, L.P., Grand Prairie, TX (US)

( * ) Notice: Subject to any disclaimer, the term of this patent is extended or adjusted under 35 U.S.C. 154(b) by 31 days.

(21) Appl. No.: 15/876,317

(22) Filed: Jan. 22, 2018

(65) Prior Publication Data

US 2018/0356088 A1 Dec. 13, 2018

Related U.S. Application Data

(60) Provisional application No. 62/516,720, filed on Jun. 8, 2017.

(51) Int. Cl.

| | |
|---|---|
| ***F21V 33/00*** | (2006.01) |
| ***F21V 21/40*** | (2006.01) |
| ***A47G 23/02*** | (2006.01) |
| ***F21V 23/04*** | (2006.01) |
| *F21Y 115/10* | (2016.01) |
| *F21Y 103/30* | (2016.01) |

(52) U.S. Cl.

CPC ..... *F21V 33/0036* (2013.01); *A47G 23/0216* (2013.01); *F21V 21/406* (2013.01); *F21V 23/0414* (2013.01); *F21Y 2103/30* (2016.08); *F21Y 2115/10* (2016.08)

(58) Field of Classification Search

CPC .. F21V 33/036; F21V 21/406; F21V 23/0414; A47G 23/0216

See application file for complete search history.

(56) References Cited

U.S. PATENT DOCUMENTS

| | | | | |
|---|---|---|---|---|
| 8,136,957 | B1 * | 3/2012 | Balcarran | A45C 11/34 362/154 |
| D701,079 | S | 3/2014 | Arora | |
| 8,931,910 | B1 | 1/2015 | Brown | |
| 9,568,186 | B2 | 2/2017 | Brown | |
| 9,795,233 | B2 | 10/2017 | Brown et al. | |
| 2007/0210095 | A1 * | 9/2007 | Bigger | A47G 23/0216 220/741 |
| 2009/0122523 | A1 * | 5/2009 | Rycroft | A47G 19/2227 362/101 |
| 2009/0175049 | A1 * | 7/2009 | Lota | B60N 3/101 362/488 |
| 2012/0002400 | A1 | 1/2012 | Lindholm | |
| 2012/0127699 | A1 * | 5/2012 | Chang | A47G 19/2227 362/101 |
| 2015/0077975 | A1 | 3/2015 | Brown | |
| 2017/0146228 | A1 | 3/2017 | Brown | |

FOREIGN PATENT DOCUMENTS

| | | | |
|---|---|---|---|
| CA | 2924887 | A1 | 3/2015 |
| WO | WO 2015/042333 | A2 | 3/2015 |

* cited by examiner

*Primary Examiner* — Anabel Ton

(74) *Attorney, Agent, or Firm* — Thorpe North & Western LLP

(57) ABSTRACT

A lighted holding device is disclosed having at least one ring, having a hollow center, an outside surface, and an inside surface, said ring configured to receive a beverage container therein. The ring has a handle coupled thereto and a light source disposed opposite the handle. The device also has a power source coupled to the light source and a switch coupled to the power source and the light source.

18 Claims, 6 Drawing Sheets

LIGHTED TUMBLER HOLDER

PRIORITY CLAIM

This application claims priority to U.S. Provisional Patent application 62/516,720 filed on Jun. 8, 2017 entitled "Lighted Tumbler Holder" which is incorporated herein by reference in its entirety.

FIELD OF THE TECHNOLOGY

The present technology relates to hand-held lighted devices. More specifically, the present technology relates to a lighted hand-held device that is configured to hold a removable tumbler or beverage container.

BACKGROUND

Personal beverage containers, such as coffee tumblers, mugs, and the like, are used by beverage consumers everywhere. Although such personal beverage containers have traditionally been primarily for use at fixed locations, such as at home or at the office, more and more frequently, consumers are finding it desirable to have a beverage during transitions, for example, while traveling from home to work or during driving excursions. Specialty coffee stores serving premium coffees and other beverages—for example, those sold under the Starbucks® trademark—are finding widespread popularity.

Certain considerations are particularly relevant when the user intends to consume the beverage, at least partially, while traveling from one place to another. For example, it is typically desirable to maintain the temperature of the beverage, i.e., to keep hot beverages hot and/or cold beverages cold. Oftentimes the consumer will purchase the beverage at one location and travel to a second, possibly distant location, to consume the beverage. It is desirable that the beverage be maintained close to the preferred temperature for sufficient periods of time. Also, it is generally desirable to include a lid in order to reduce the likelihood of splash or spillage of the beverage during travel. Finally, particularly for reusable beverage containers, the container must be rugged enough to withstand the inevitable bump or fall.

Very often personal beverage containers are designed to be used once and then disposed of. Disposable cups with lids are well known in the art. Many consumers, however, prefer a beverage container that is sturdier than these disposable cups and that can be cleaned and reused. Another advantage of reusable beverage containers is that it reduces the burden on landfills and the like by reducing the use of disposable cups and lids. Reusable beverage containers are also known in the art and are frequently made from metal, glass, and/or plastic. Irrespective of the use of disposable or reusable beverage containers, numerous holding devices have been used in connection with portable beverage containers in an effort to facilitate handling of the beverage containers. There is no container holder, however, that functions as a tool for beverage consumption as well as lighting the area about the holding device.

BRIEF DESCRIPTION OF THE DRAWINGS

The present technology will become more fully apparent from the following description and appended claims, taken in conjunction with the accompanying drawings. Understanding that these drawings merely depict exemplary aspects of the present technology, they are therefore not to be considered limiting of its scope. It will be readily appreciated that the components of the present technology, as generally described and illustrated in the figures herein, could be arranged and designed in a wide variety of different configurations. Nonetheless, the technology will be described and explained with additional specificity and detail through the use of the accompanying drawings in which:

DESCRIPTION OF EMBODIMENTS

Figure 1A:
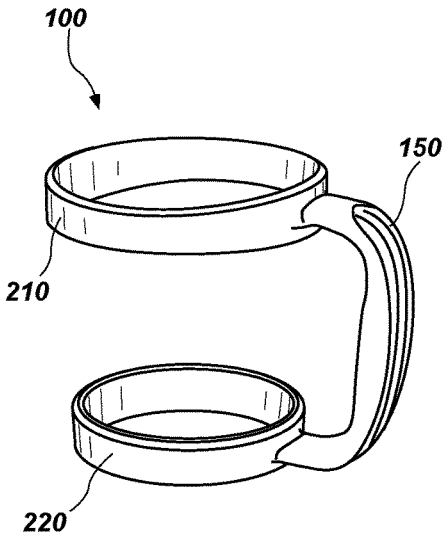
FIGS. 1A through 1D are examples of different tumbler holding devices in accordance with aspects of the technology.
Figure 1B:
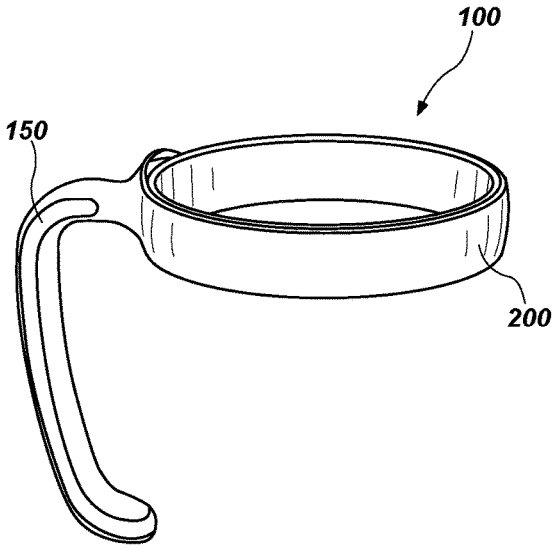
Figure 1C:
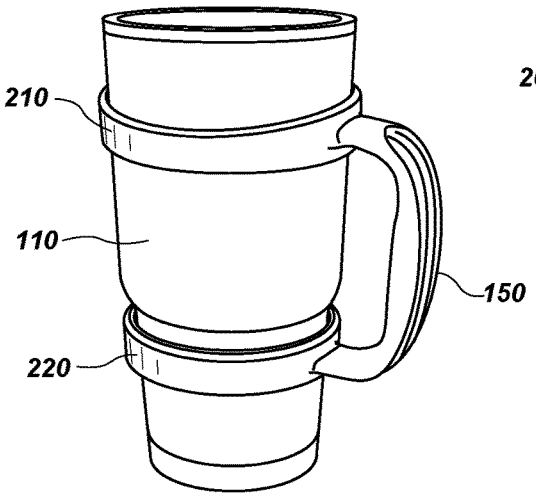
Figure 1D:
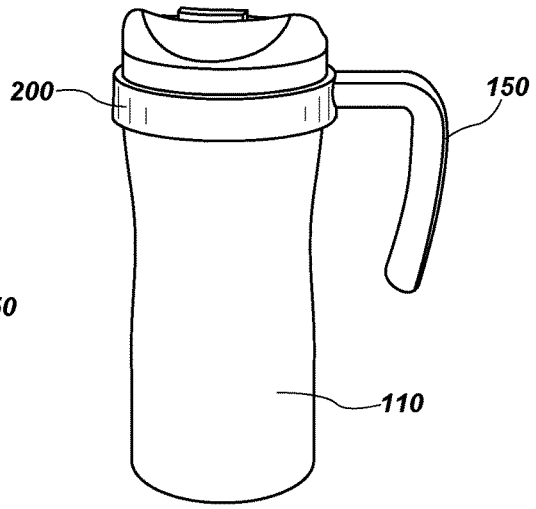

Although the following detailed description contains many specifics for the purpose of illustration, a person of ordinary skill in the art will appreciate that many variations and alterations to the following details can be made and are considered to be included herein. Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about". For example, for the sake of convenience and brevity, a numerical range of "about 50 angstroms to about 80 angstroms" should also be understood to provide support for the range of "50 angstroms to 80 angstroms."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

Reference in this specification may be made to devices, structures, systems, or methods that provide "improved" performance. It is to be understood that unless otherwise stated, such "improvement" is a measure of a benefit obtained based on a comparison to devices, structures, systems or methods in the prior art. Furthermore, it is to be understood that the degree of improved performance may vary between disclosed embodiments and that no equality or consistency in the amount, degree, or realization of improved performance is to be assumed as universally applicable.

The term "flashlight" as used herein is used as an example of a lighting device that may employ the technology herein but should not be construed as limiting what kinds of lighting devices may employ the current technology. As such, the term flashlight should be broadly construed to include lighting devices that employ numerous types of electronics or lighting technology, including, but not limited to LED technology.

An initial overview of the technology is provided below and specific technology embodiments are then described in further detail. This initial summary is intended to aid readers in understanding the technology more quickly, but is not intended to identify key or essential features of the technology, nor is it intended to limit the scope of the claimed subject matter.

Broadly speaking, aspects of the current technology improves tumbler holding devices by providing one or more lighting elements incorporated into a tumbler holding handle. The handle comprises a member that is configured to slide over and secure a beverage container. The handle is lighted and functions like a flashlight or area light for the user.

Generally speaking, the term tumbler refers to a flat-bottomed beverage container. In one aspect of the technology, a tumbler (or beverage container) holding device comprises a handle configured with an opening that is intended to secure, at least to some degree, a beverage container therein. In one aspect, the opening comprises one or more rings that are coupled to the handle. One or more of the rings comprises a first lighting element (e.g., an LED) that is disposed opposite the handle. That is, in a direction opposite from where a user would grasp the handle. The lighting element is configured to direct light in a direction opposite (or away from) the handle in a direction that is parallel to a top surface of the ring. In this manner, when a beverage container is housed within the holding device and held by the consumer, the first lighting element directs light wherever the consumer "points" the front end of the holding device. While the field of illumination is generally parallel with a top surface of the ring, the total field of illumination can be broader, ranging from plus or minus 45 degrees from an imaginary axis that is parallel with a top plane of the ring.

In another aspect of the technology, the one or more rings comprises a second lighting element disposed about a bottom portion of at least one of the rings. The second lighting element directs light in a direction that is generally perpendicular the direction of light emitted from the first lighting element. However, the field of illumination from the second lighting element can include light directed at an angle ranging from 0 to 90 degrees with respect to general direction of the first light. In this manner, when the user grasps the holding device by the handle, the area about the feet of the user can be illuminated by the second lighting element while an area forward of the user can be lighted by the first lighting element. Alternatively, when a beverage container is housed within the holding device, the user may place the beverage container on a flat surface (e.g., a table) wherein the second lighting element would provide light in the area about the general area of the bottom of the beverage container. In one aspect of the technology the field of illumination from the first light source overlaps with the field of illumination from the second light source. However, in another aspect of the technology, the fields of illumination from the two different sources do not overlap.

With reference generally to FIGS. 1A through 1D, numerous types and styles of beverage container holding devices are contemplated for use herein. Each of the different styles of beverage container holding devices, indicated generally at 100, comprise a handle 150 that is coupled to one or more rings configured to house a beverage container 110 therein. While rings are specifically referenced herein, it is understood that any geometry capable of holding a beverage container therein is contemplated for use. For example, the handle 150 may be coupled to an open rectangle, open oval, or a semi-circle, semi-oval, or semi-rectangle so long as the holding device is capable of securing a beverage container therein by slidably receiving the beverage container therein or by frictional engagement.

In one aspect of the technology, the rings 200 (or other beverage-holding geometry) are configured to permit the beverage container to be slidably placed into the rings by directing the beverage container "bottom-end-first" through a top of the ring 200. The beverage container can also be slidably removed from the beverage container in the reverse direction. In one aspect, the holding device 100 comprises an upper ring 210 and a lower ring 220, though it may comprise a single ring 200, or more than two rings as suits a particular application. In another aspect of the technology, the gripping member (ring, open rectangle, or otherwise) is configured with an open end having opposing arms that flex outwardly when a beverage container 110 is placed therein. In this aspect, the flexed arms frictionally hold the beverage container 110 in place.

Figure 2:
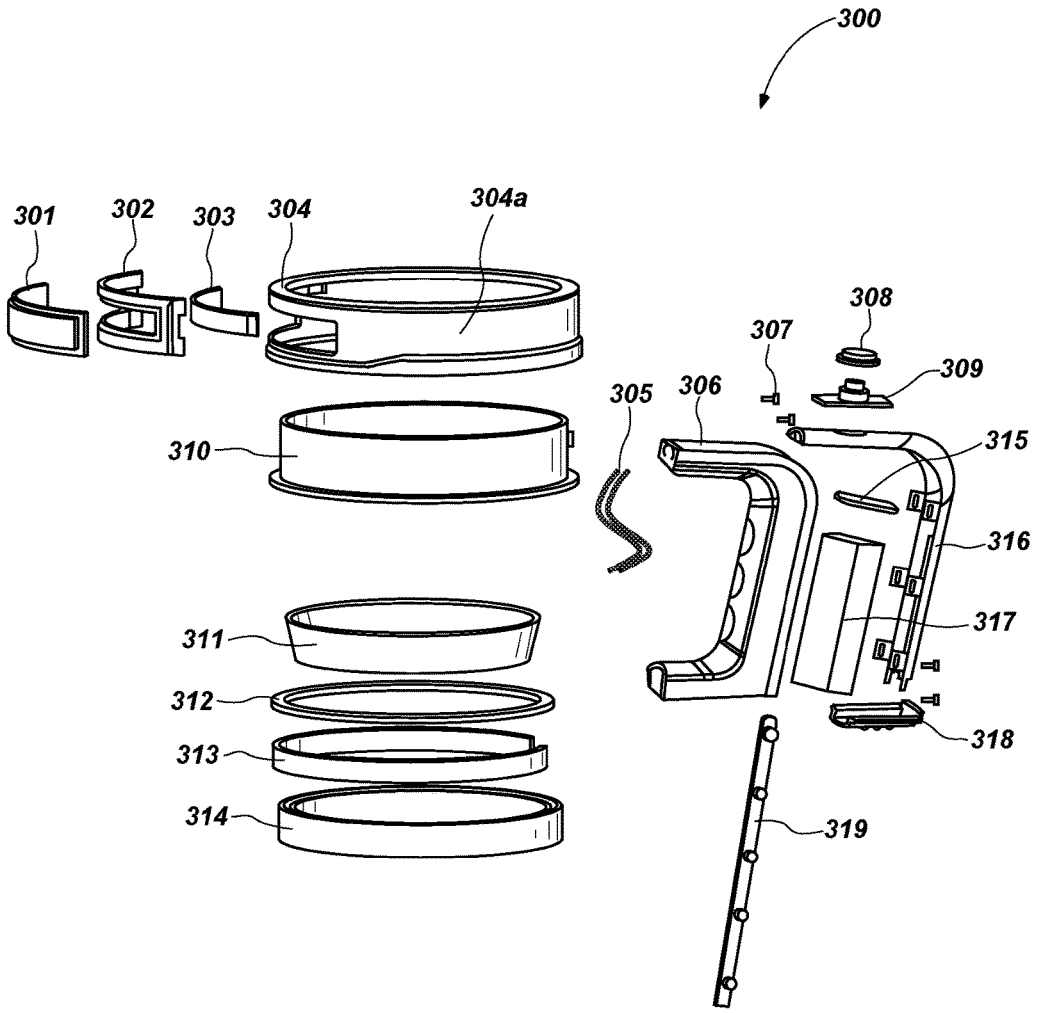
FIG. 2 is an exploded view of a lighted tumbler holding device in accordance with one aspect of the technology.

With reference generally to FIG. 2, an exploded view of a beverage container holding device 300 is illustrated in accordance with one aspect of the technology. The holding device 300 (sometimes called a tumbler handle) generally comprises a handle 306 coupled to an upper capture ring 304 and a lower capture ring 314. In one aspect, the upper and lower capture rings as well as the handle are made of a polymeric material such as acrylonitrile butadiene styrene, though plastic, rubber, or other polymeric materials (e.g., urethanes, polyethylene, polyvinyl chloride, etc.) may be used. The upper capture ring 304 is sized to accommodate placement of a smaller diameter bottom end of a beverage container therethrough while retaining a larger diameter upper end of the beverage container therein. The lower capture ring 314 is sized to accommodate placement of a smaller diameter bottom end of the beverage container while retaining a larger diameter bottom portion of the beverage container. A light source 303 is disposed on a first side of the upper capture ring 304 and electrically coupled to a power source (e.g., a battery, etc.) located within the handle 306. In one aspect, the upper capture ring 304 comprises an insert 310 providing a contact surface for engaging an outer sidewall of the beverage container. In one aspect, the insert 310 comprises a silicone insert that can be replaced to accommodate a different sized tumbler therein. That is, the insert 310 is removable and replacement with a different insert having a different inner diameter (or different shape altogether) to accommodate placement of different sized beverage containers therein.

In one aspect of the technology, the light source 303 comprises a chip-on-board (COB) LED (light emitting diode) strip, or other LED arrangement disposed on a flexible or inflexible substrate and formed into an arc shape. In another aspect, the light source comprises a plurality of individual LED lights or a single non-COB LED light configured in a strip and formed into an arc shape. In yet another aspect, the light source 303 comprises a single LED. A reflector 302 is located about a perimeter of the light source 303 to assist in the propagation of light from light source 303. In one aspect of the technology, the light source 303 is disposed on an end of the upper capture ring 304 in a manner that propagates light generally in a direction that is parallel with a top of the upper capture ring 304 though the field of illumination of light source 303 ranges approximately plus or minus 45 degrees from an imaginary axis passing through a center of the ring 304 and parallel to a plane about a top of the ring 304. In this manner, when the user is holding a beverage container in an upright position in front of the user, the light from light source 303 is propagated generally away from the user in a forward direction. However, the light from light source 303 may be directed in a variety of different directions with respect to the user, depending on how the holding device is oriented. In any event, the light from the light source 303 is directed generally away from the handle 306 of the holding device or in a direction that is opposite the handle 306 disposed on an opposing side of ring 304. In one aspect of the technology, a lens 301 is disposed a top the light source 303 and reflector 302. The light source 303 is curved such that the field of illumination extends outward from the handle 306 in a forward direction. Depending on how long the COB LED strip (or other LED configuration) extends, the field of illumination of light source 303 also extends laterally from the ring 304. In other words, as the length of light source 303 increases, it reaches around the circumference of the ring 304 to extend in a direction that illuminates an area about the lateral sides 304*a* of ring 304.

In one aspect of the technology, the lower capture ring 314 comprises an insert 311 made from a polymeric material, resilient rubber material, or other plastic material that provides a contact surface for the beverage container within the lower capture ring 314. A light source 313 is disposed within the lower capture ring with a cap 312 placed above the light source 313. In one aspect of the technology, the light source 313 comprises a COB LED array placed on a flexible or inflexible substrate and configured in an arc to fit about the curvature of the bottom of the lower capture ring 314. In one aspect, the light from light source 313 is propagated in a direction that is parallel to a longitudinal direction of the beverage container when it is placed in the holder. In other words, it is directed downward when the beverage container holder and beverage container are in an upright position or downward in the direction of the bottom of the lower capture ring 314. In this aspect, the COB LED array is configured such that an imaginary axis through the center of each LED is parallel (i.e., each one is directed in a parallel direction).

In another aspect, the light from light source 313 is propagated in a direction that is parallel to a direction of light coming from light source 303 and is configured about an exterior circumference of the lower capture ring 314. That is, the field of illumination extends outward from the sides of the lower capture ring 314 instead of being propagated downward from a bottom of the capture ring.

Figure 3:
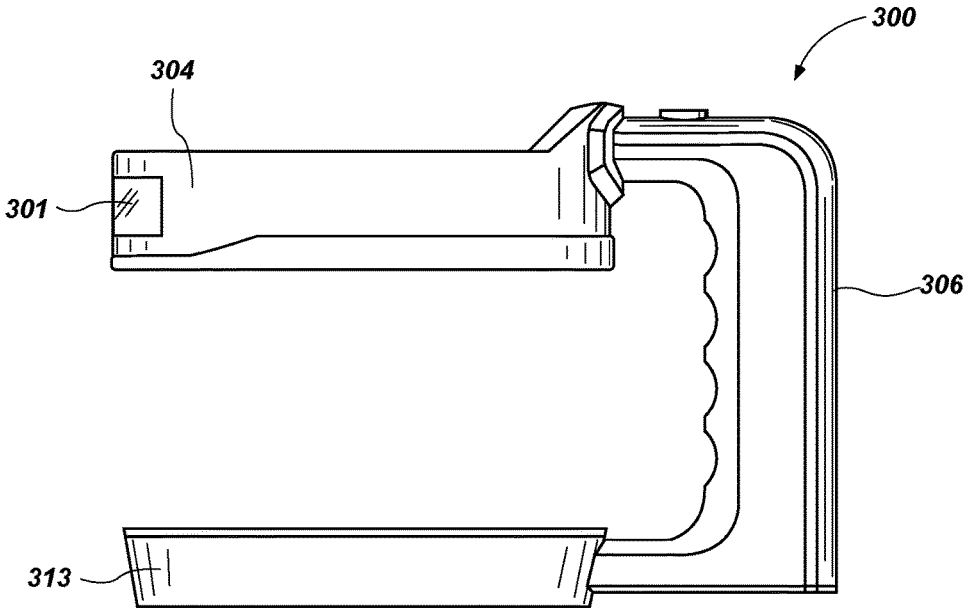
FIG. 3 is a side view of a tumbler holding device in accordance with one aspect of the technology.
Figure 4:
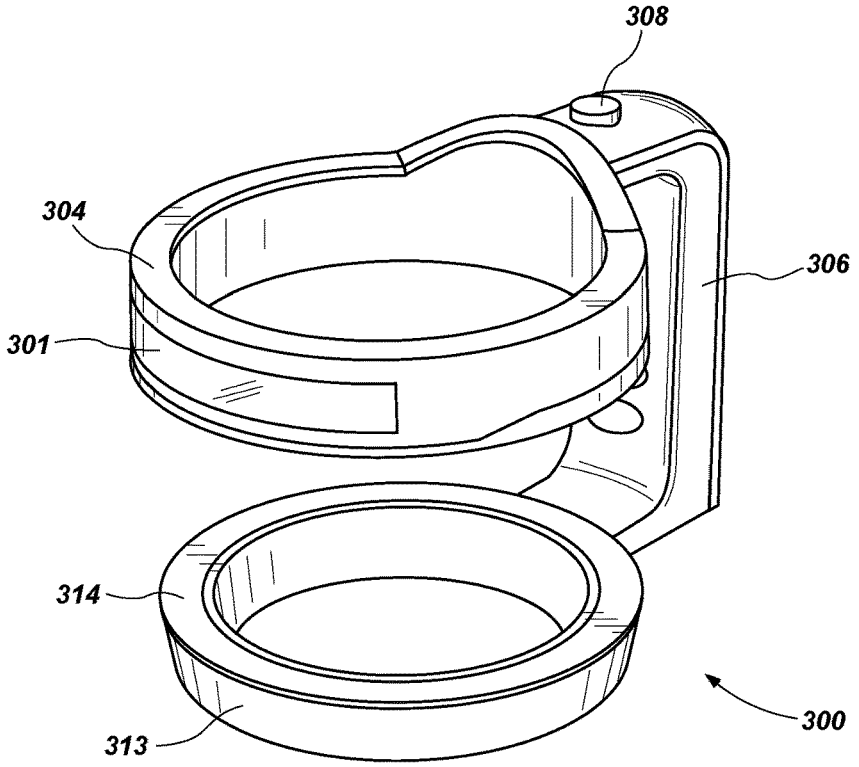
FIG. 4 is a perspective view of the tumbler holding device shown in FIG. 3.
Figure 5:
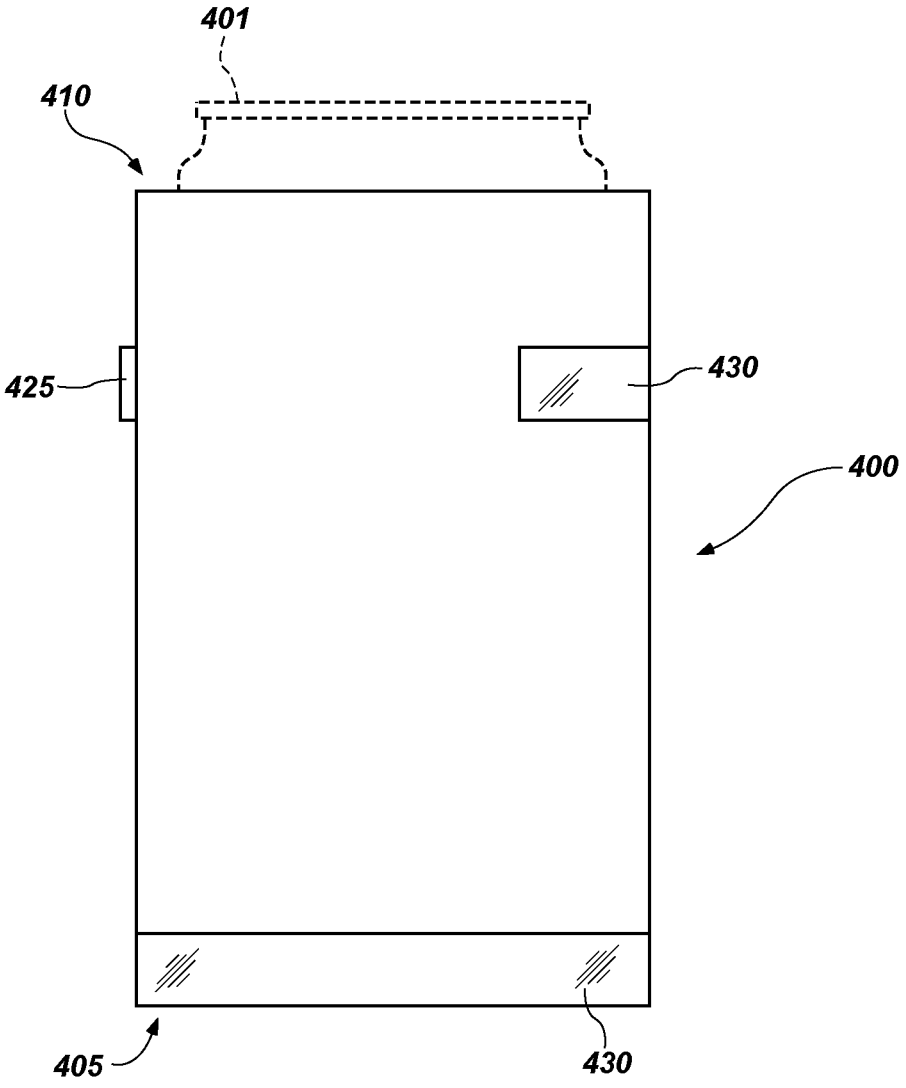
FIG. 5 is a side view of a beverage holding device in accordance with one aspect of the technology.
Figure 6:
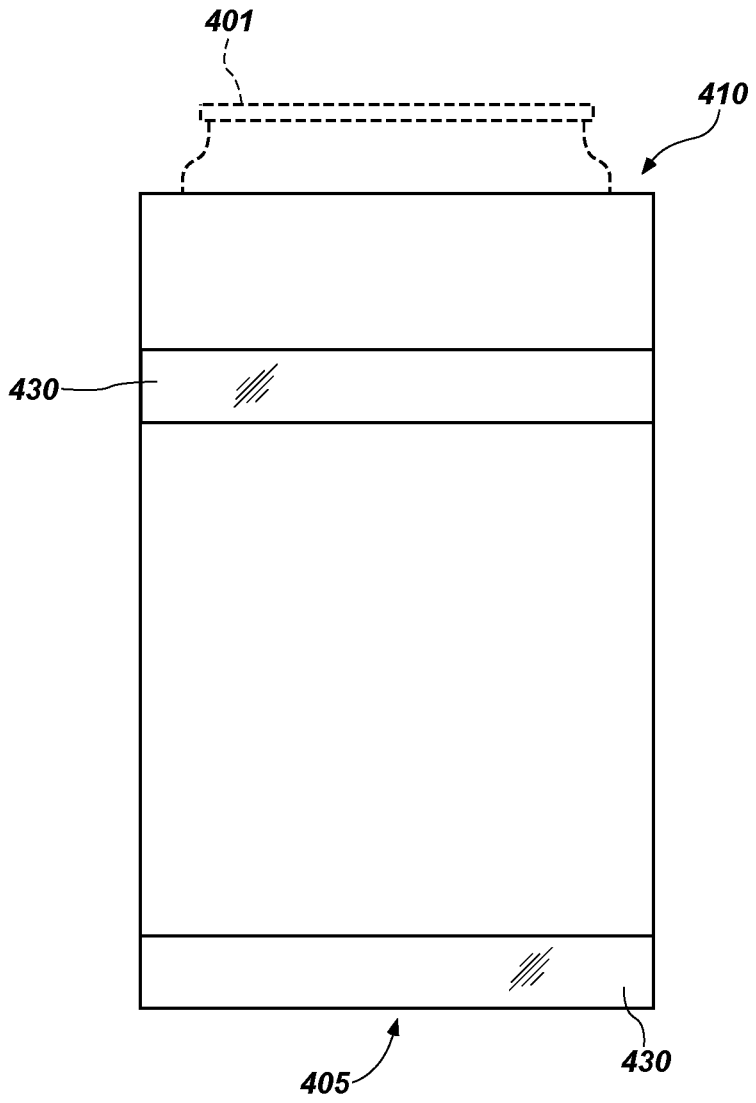
FIG. 6 is a front view of a beverage holding device in accordance with one aspect of the technology.
Figure 7:
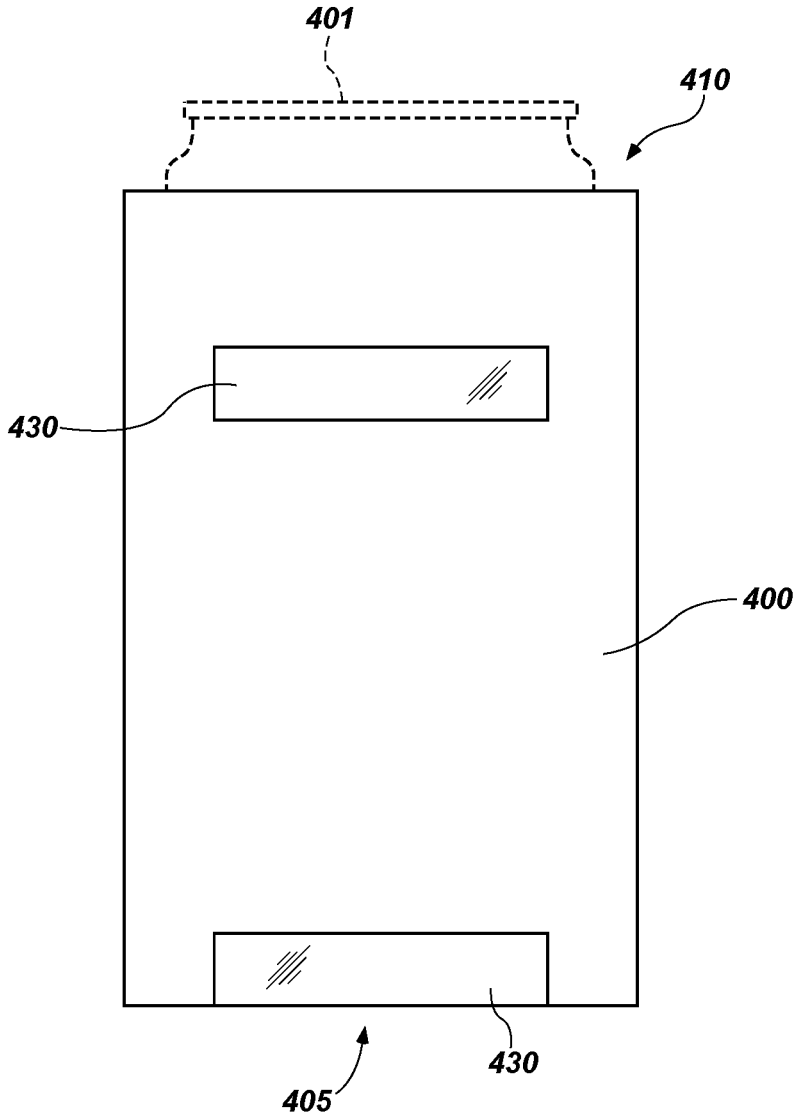
FIG. 7 is a front view of a beverage holding device in accordance with one aspect of the technology.

With specific reference to FIGS. 3 and 4, in yet another aspect of the technology, the light from light source 313 is directed both downward and outward. Specifically, in this aspect, the field of illumination is of the COB LED associated with the second light source 313 is intended to create an area light that propagates light downward and outward from the holding device. In this manner, an area light is created. In order to create an area light, in accordance with one aspect, the COB LED is configured to create a wedge shape on the lower capture ring 314. Meaning, the COB LED is disposed at an angle with respect to the top and bottom plane of the lower capture ring 314. In this manner, light is propagated both outward and downward. In one aspect, however, reflectors and/or light blocking members are used to direct light emanating from the light source 313 in a downward and outward direction. The light sources discussed herein may be mounted in an aperture within one or more rings, or they may be fixed about an outside surface of the rings as suits a particular application. The beverage container holding device 300 may also have third and fourth (or more light sources) disposed about various parts of the ring. For example, a third light source may be located on the top of the upper capture ring or on the back side of the upper capture ring.

While reference is made herein to an upper capture ring 304 and lower capture ring 314, it is understood that a beverage container holding device may comprise a single capture ring with a forward directed light source (like that shown in 303), a generally downward directed area light source (like that shown in 313), and/or a circumferential light source. Meaning, it is not necessary for the holding device to have two rings. A forward directed light and an area light may be disposed about a single ring like the single ring shown in FIG. 1D. Likewise, the forward directed light source may be on the lower capture ring 314 and the downward directed light source may be on the upper capture ring 304 as suits a particular application. In an additional aspect where a single capture ring is used, a forward directed light source 303 and downward directed light source 313 are located both on an upper capture ring 304.

In addition, in an aspect where the upper capture ring has an open end opposite the handle 306 and individual arms that are capable of flexing outwardly to receive a beverage container therein, one or more light sources may be placed on individual arms of the open ends of the upper capture ring. The one or more light sources on the individual arms provide the forward directed light similar to that shown at 303 in FIGS. 2-4.

In one aspect of the technology, light source 303 and light source 313 (to the extent both light sources are used) coupled to a power source located within handle 306 by way of wires 305 or other electrical coupling means. The handle 306 comprises an open cavity with a power source such as a portable battery pack 317 having a cap 318 for enclosing batteries therein. A handle cover 316 is secured to the handle 306 by way of screws 307 or some other securement mechanism. The power source is coupled to a circuit board 315 that is coupled to a control switch 309 (enclosed by rubber cover 308) for cycling through different lighting modes. In accordance with one aspect of the technology, the different light sources and different lighting modes are controlled by software or logic controlled switches or mechanical switches located on the circuit board 315. In one aspect of the technology, the circuit board 315 is configured to permit a first mode wherein light source 303 is activated and light source 313 is inactive, a second mode where light source 313 is activated and light source 303 is inactive, a third mode where light source 303 and light source 313 are both activated. Other light modes are contemplated including a strobe mode, and different colored LED modes. For example, one or both of the light sources 303 or 313 may comprise different colored LEDs (e.g., white, yellow, red, etc.) and/or dimming functions. In another aspect of the technology, the power source comprises a rechargeable battery located within the cavity of handle 306. In that aspect, the power source is coupled to an external port where a user may charge a phone or other electronic device directly from the holding device itself.

In aspects of the technology referenced herein, a lighted beverage container holder 300 comprises a handle 306 extending distally away from either a single ring, or multiple rings 304, 314 that house the beverage container therein. In the aspect where multiple rings are used (see, e.g., FIGS. 1A, 1C, and 2 through 4), each of the rings are coupled to the handle 306. That is an upper ring 304 is coupled to a top portion of the handle 306 and a lower ring 314 is coupled to a bottom portion of the handle 306. In some aspects, however, the handle 306 may couple to the rings at different points about the handle. In another aspect of the technology, the handle 306 does not extend laterally away from rings. Rather, the handle 306 extends downward from an upper ring 304 to a lower ring 314 in a substantially linear direction. In one aspect of the technology where the handle 306 extends downward and not outwardly, a similarly directed handle 306 is disposed on an opposite side of the rings 304 and 314. In this aspect, the user does not grip a single handle to secure the device 300 in his or her hand. Rather, the user secures the device 300 in his or her hand by griping both handles in a single hand. In this aspect of the technology, the switch 308 used to power first and/or second lighting elements is placed on a lateral side of the handle so that it may be operated by the thumb of the user. In addition, the orientation of the first lighting element on the upper ring 304 may not be placed directly opposite either one of the handles, though, in one aspect, the first light element 301 is disposed about the upper ring 304 opposite the handle 306 that contains the power switch 308. While reference is made herein to a power source located within the handle 306 of the lighted holding device 300, it is understood that the power source (e.g., battery pack) can be located within the rings 304 or 314.

In another aspect of the technology, the beverage container holding device comprises a collapsible or rigid sleeve 400 for a beverage container such as a can 401 or bottle of arbitrary shape and size. The sleeve 400 comprises an insulating jacket surrounding the container sides of the can when the can is inserted therein. The jacket has a substantially closed lower end 405 for supporting the can or bottle and an open upper end 410 forming an axis opening. In one aspect where the sleeve is collapsible, the jacket is formed of inner and/or outer, water resistant fabric layers within which is disposed a layer of insulating material, all coupled together. The jacket preferably has a cylindrical configuration but it is understood that other configurations conforming to shapes of particular containers to which the sleeve 400 is adapted may be provided. In one aspect where the sleeve 400 is rigid, the jacket comprises an flexible insulating material (such as an open or closed-cell foam, neoprene, or other insulating material) coupled with a rigid polymeric shell. In one aspect, the rigid shell comprises an exterior of the jacket while the insulating material is placed on the interior of the rigid shell intended to be in direct contact with the can or bottle disposed therein. In another aspect of the technology, the insulating material is placed on the outside of the rigid shell, wherein the can or bottle is in direct contact with the flexible insulating material disposed therein.

In accordance with one aspect of the technology, one or more light sources 420 are disposed about the outer layer and coupled to a power source, circuit board, and switch 425 for controlling different modes of the light sources 420. In one aspect, the power source comprises a substantially flat battery disposed in a pocket of the jacket. The pocket may be located on the lower end 405 or side 406 of the sleeve 400. In accordance with one aspect, the one or more of the light sources 420 comprise a COB LED strip 430 disposed on a flexible or inflexible substrate, though other LED light sources are contemplated for use herein. In a collapsed configuration, the COB LED strip 430 is configured in a flat or planar orientation to match a flat configuration of the collapsed sleeve 400. When the sleeve 400 houses a can or bottle, the sleeve 400 assumes a cylindrical or arcuate shape and the COB LED strip 430 assumes an arcuate shape to approximate the shape of the sleeve 400. In one aspect of the technology, the battery pack is spaced apart from the switch 425 in such a manner than when housing a can and being held by a user, the battery pack is positioned near the palm of the hand of the user and the switch 425 is positioned near the thumb of the hand of the user. The COB LED strip 430 is positioned opposite the switch 425 and is configured to propagate light in a direction away from the switch 425. In another aspect, a COB LED strip 430 is configured to be placed on opposing sides of the collapsible sleeve 400 such that when the sleeve is housing a can or bottle, an LED ring is formed about the circumference of the sleeve 400. In another aspect, the COB LED strip 430 can extend about the circumference of the sleeve 400 or only a portion of the circumference. In one aspect of the technology, one or more COB LED strips 430 are placed at different elevations about the sleeve 400 having different fields of illumination, including an aspect where the COB LED strip has an angled configuration similar to that shown on FIG. 4 at 313 so as to provide light in both a downward and outward direction.

The foregoing detailed description describes the technology with reference to specific exemplary aspects. However, it will be appreciated that various modifications and changes can be made without departing from the scope of the present technology as set forth in the appended claims. The detailed description and accompanying drawings are to be regarded as merely illustrative, rather than as restrictive, and all such modifications or changes, if any, are intended to fall within the scope of the present technology as described and set forth herein.

More specifically, while illustrative exemplary aspects of the technology have been described herein, the present technology is not limited to these aspects, but includes any and all aspects having modifications, omissions, combinations (e.g., of aspects across various aspects), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus-function are expressly recited in the description herein. Accordingly, the scope of the technology should be determined solely by the appended claims and their legal equivalents, rather than by the descriptions and examples given above.

The invention claimed is:

1. A lighted holding device, comprising:

an upper ring and a lower ring, each ring having a hollow center, an outside surface, and an inside surface, each ring configured to receive a portion of a beverage container therein;

a handle coupled to a first side of each ring;

a first light source disposed about a second side of the upper ring, said first side and second side being disposed on opposite sides of the upper ring, wherein the first light source comprises a curved LED array disposed about the upper ring, the curved LED array comprising a radius of curvature that is equivalent to a radius of curvature of the upper ring;

a second light source disposed about the lower ring;

a power source coupled to the first and second light source;

a switch coupled to the power source and the first and second light source.

2. The holding device of claim 1, wherein the power source is located within a cavity of the handle and the switch is disposed about a top surface of the handle.

3. The holding device of claim 1, wherein the second light source comprises a curved LED array disposed the lower ring, the curved LED array comprising a radius of curvature that is equivalent to a radius of curvature of the lower ring.

4. The holding device of claim 1, wherein the first light source comprises a curved LED array that operates to propagate light in a direction that is parallel with an imaginary plane disposed about a top of the upper ring.

5. The holding device of claim 1, wherein the first light source comprises a curved LED array that operates to propagate light in a direction that is parallel with an imaginary axis passing through a top portion of the handle.

6. The holding device of claim 1, wherein the second light source comprises a curved LED array circumscribing the lower ring and operates to propagate light outward and downward from the lower ring.

7. The holding device of claim 1, wherein the second light source comprises a curved LED array disposed at an angle with respect to an imaginary plane disposed about a top of the lower ring.

8. The holding device of claim 1, wherein the first and second rings comprise a tapered inside surface forming an angle with respect to an imaginary plane disposed about a top of the upper ring and an imaginary plane disposed about a top of the lower ring, respectively.

9. The holding device of claim 1, wherein the field of illumination of the first light source and the field of illumination of the second light source do not overlap.

10. The holding device of claim 1, wherein the upper ring has an internal diameter that is greater than an internal diameter of the lower ring.

11. A holding device, comprising:

a ring, having a hollow center, an outside surface, and an inside surface, said ring configured to receive a beverage container therein in contact with an inside surface;

a handle coupled to an outside surface of the at least one ring;

a first light source disposed about the ring on an opposite side of the handle, wherein the light source comprises a curved COB LED array having a radius of curvature that is equivalent to a radius of curvature of the ring, the light source being faced in a direction opposite the handle;

a power source located within the handle coupled to the light source; and a switch coupled to the power source and the light source.

12. The holding device of claim 11, wherein the power source is located within a cavity of the handle and the switch is disposed about a top surface of the handle.

13. The holding device of claim 11, further comprising a second ring having a second light source disposed about the second ring, the second light source comprising a curved COB LED having an angled face with respect to an imaginary plane disposed about a top surface of the ring.

14. The holding device of claim 13, wherein the second light source creates a circular field of illumination directed laterally outward from the second ring and downward from the second ring.

15. The holding device of claim 13, wherein the switch operates to selectively turn on the first light source or the second light source or both the first and second light source at the same time.

16. A lighted device for holding a beverage container, comprising:

an upper ring and a lower ring, each ring having a hollow center, an outside surface, and an inside surface, each ring configured to receive a portion of a beverage container therein;

a handle coupled to each ring;

a first light source disposed about the upper ring;

a second light source disposed about the lower ring, wherein the second light source comprises a curved LED array disposed about the lower ring, the curved LED array comprising a radius of curvature that is equivalent to a radius of curvature of the lower ring;

a power source coupled to the first and second light source;

a switch coupled to the power source and the first and second light source.

17. The device of claim 16, wherein the second light source is configured to propagate light downward from the lower ring.

18. The device of claim 16, wherein the first lights source is configured to propagate light away from the upper ring in a direction that is normal to a longitudinal axis of the handle.

* * * * *